US012398913B2

(12) United States Patent
Anderson et al.

(10) Patent No.: US 12,398,913 B2
(45) Date of Patent: Aug. 26, 2025

(54) ADJUSTABLE DIFFUSER ASSEMBLY SYSTEMS AND METHODS

(71) Applicant: Air Distribution Technologies IP, LLC, Milwaukee, WI (US)

(72) Inventors: Justin Eagan Anderson, Sachse, TX (US); Ramesh Parjapat, Tadipatri (IN); Neal Thomas Holden, Allen, TX (US); Vikas Hari Dhote, Pune (IN); Mark James Costello, Sr., Plano, TX (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 638 days.

(21) Appl. No.: 17/562,836

(22) Filed: Dec. 27, 2021

(65) Prior Publication Data

US 2022/0205677 A1 Jun. 30, 2022

Related U.S. Application Data

(60) Provisional application No. 63/131,222, filed on Dec. 28, 2020.

(51) Int. Cl.

| | |
|---|---|
| ***F24F 13/06*** | (2006.01) |
| ***F24F 13/02*** | (2006.01) |
| ***F24F 13/10*** | (2006.01) |
| ***F24F 13/32*** | (2006.01) |

(52) U.S. Cl.

CPC ..... *F24F 13/06* (2013.01); *F24F 13/0209* (2013.01); *F24F 13/10* (2013.01); *F24F 13/32* (2013.01); *F24F 2221/00* (2013.01)

(58) Field of Classification Search

CPC ..... F24F 13/06; F24F 13/0209; F16L 25/14; F16L 41/12; F16L 21/06; F16L 5/00

USPC ..... 285/67, 419

See application file for complete search history.

(56) References Cited

U.S. PATENT DOCUMENTS

2003/0177724 A1* 9/2003 Botting ..... F24F 13/06 52/302.1
2010/0201121 A1* 8/2010 Jensen ..... F24F 13/0236 285/189
2014/0167405 A1* 6/2014 Lahey ..... F24F 13/06 285/64

FOREIGN PATENT DOCUMENTS

KR 20120001017 U * 2/2012
WO WO-2010119227 A1 * 10/2010 ..... F24F 13/0209

* cited by examiner

*Primary Examiner* — Edelmira Bosques
*Assistant Examiner* — Michael James Giordano
(74) *Attorney, Agent, or Firm* — Michael Best & Friedrich LLP

(57) ABSTRACT

A diffuser assembly for a heating, ventilation, and air conditioning (HVAC) system includes a housing having a wall and a passage formed in the wall. The diffuser assembly also includes a first adjustment panel moveably coupled to the wall and having a first flange and a second adjustment panel moveably coupled to the wall and having a second flange. The first flange and the second flange define at least a portion of an inlet port of the diffuser assembly that extends through the passage. The inlet port is configured to fluidly couple to a duct and direct an air flow from the duct into an interior volume of the housing. The first adjustment panel and the second adjustment panel are configured to translate along the wall to adjust a size of the inlet port.

19 Claims, 13 Drawing Sheets

ADJUSTABLE DIFFUSER ASSEMBLY SYSTEMS AND METHODS

CROSS-REFERENCE TO RELATED APPLICATIONS

This application claims priority from and the benefit of U.S. Provisional Application No. 63/131,222, entitled "ADJUSTABLE AIR INLET DIFFUSER," filed Dec. 28, 2020, which is herein incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and air conditioning (HVAC) systems are utilized in residential, commercial, and industrial environments to control environmental properties, such as temperature and humidity, for occupants of the respective environments. The HVAC system may regulate the environmental properties through delivery of a conditioned air flow to the environment. For example, the HVAC system generally includes an HVAC unit that is fluidly coupled to various rooms or spaces within the building via an air distribution system, such as a system of ductwork. The HVAC unit may be operable to direct a heated air flow or a cooled air flow through the ductwork and into the spaces to be conditioned. In this manner, the HVAC unit facilitates regulation of environmental parameters within the rooms or spaces of the building. Generally, one or more diffuser assemblies are fluidly coupled to the ductwork and are configured to facilitate distribution of the conditioned air into the rooms or spaces to be conditioned. Unfortunately, it may be arduous, costly, and/or time consuming to manufacture, adjust, and/or install different diffuser assemblies configured to couple to various sizes of ductwork that may be installed in the building serviced by the HVAC system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a diffuser assembly for a heating, ventilation, and air conditioning (HVAC) system. The diffuser assembly includes a housing having a wall and a passage formed in the wall. The diffuser assembly also includes a first adjustment panel moveably coupled to the wall and having a first flange and a second adjustment panel moveably coupled to the wall and having a second flange. The first flange and the second flange define at least a portion of an inlet port of the diffuser assembly that extends through the passage. The inlet port is configured to fluidly couple to a duct and direct an air flow from the duct into an interior volume of the housing. The first adjustment panel and the second adjustment panel are configured to translate along the wall to adjust a size of the inlet port.

The present disclosure also relates to a diffuser assembly for a heating, ventilation, and air conditioning (HVAC) system. The diffuser assembly includes a wall having a passage extending therethrough. The diffuser assembly also includes a first adjustment panel moveably coupled to the wall and having a first flange extending into the passage. The diffuser assembly includes a second adjustment panel moveably coupled to the wall and having a second flange extending into the passage. The first flange and the second flange define at least a portion of an inlet port extending through the passage and configured to fluidly couple to a duct. The first adjustment panel and the second adjustment panel are configured to translate along the wall between a first configuration to define a first size of the inlet port and a second configuration to define a second size of the inlet port.

The present disclosure also relates to a diffuser assembly for a heating, ventilation, and air conditioning (HVAC) system. The diffuser assembly includes a housing having a wall and a passage formed in the wall. The diffuser assembly includes a first adjustment panel having a first base portion moveably coupled to the wall. The first adjustment panel also includes a first flange extending from the first base portion into the passage. The diffuser assembly includes a second adjustment panel having a second base portion moveably coupled to the wall. The second adjustment panel also includes a second flange extending from the second base portion into the passage. The first flange and the second flange define at least a portion of an inlet port extending through the passage and configured to receive an air flow from a duct. The first base portion and the second base portion are configured to translate along the wall to expose or occlude a portion of the passage to adjust a size of the inlet port in the passage.

BRIEF DESCRIPTION OF THE DRAWINGS

Various aspects of this disclosure may be better understood upon reading the following detailed description and upon reference to the drawings in which.

DETAILED DESCRIPTION

Figure 1:
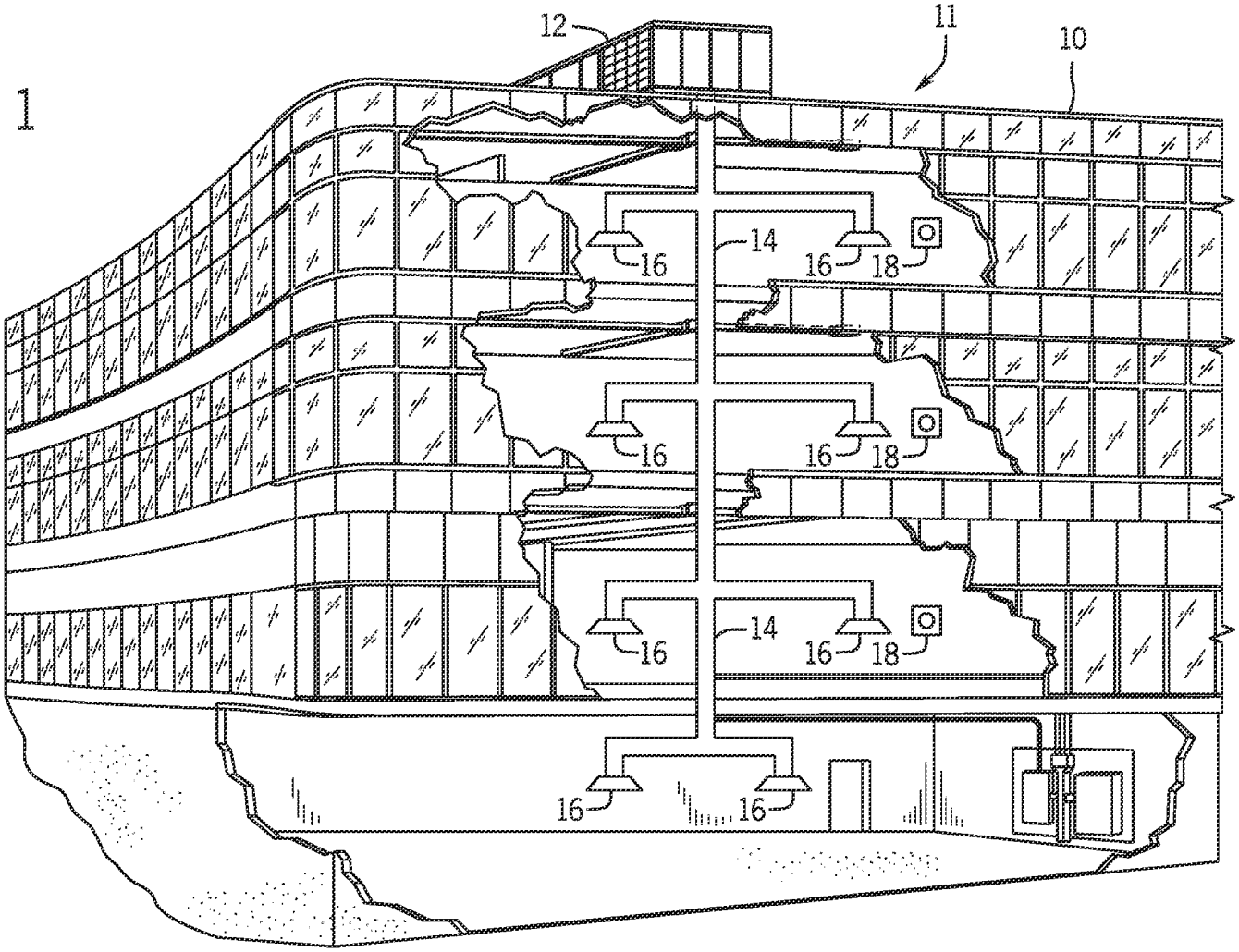
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to convey that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to convey that the given feature is within +/−5%, within +/−4%, within +/−3%, within +/−2%, within +/−1%, or even closer, to having the described nature, such as being parallel to another feature, being perpendicular to another feature, and so forth. Mathematical terms, such as "parallel" and "perpendicular," should not be rigidly interpreted in a strict mathematical sense, but should instead be interpreted as one of ordinary skill in the art would interpret such terms. For example, one of ordinary skill in the art would understand that two lines that are substantially parallel to each other are parallel to a substantial degree, but may have minor deviation from exactly parallel.

As briefly discussed above, a heating, ventilation, and/or air conditioning (HVAC) system may be used to thermally regulate a space within a building, home, or other suitable structure. The HVAC system may include an HVAC unit configured to condition an air flow via an evaporator, a furnace, a heating coil, a chiller system, another heat exchange system, or a combination thereof, and to provide the conditioned air flow (e.g., a heated air flow, a cooled air flow, a dehumidified air flow) to the space. For example, the HVAC unit may be fluidly coupled to the space via an air distribution system, such as a system of ductwork, which extends between the HVAC unit and the space. One or more fans or blowers of the HVAC system may be operable to direct a supply of conditioned air from the HVAC unit, through the ductwork, and into the spaces within the building.

Typically, the HVAC system includes one or more diffusers that are fluidly coupled to the ductwork and are configured to facilitate distribution of air from the ductwork into the rooms or spaces of the building. For example, the diffusers may be positioned adjacent to ceilings, floors, and/or walls of the rooms conditioned by the HVAC system and may be configured to discharge air from the ductwork into the rooms or other spaces. In many cases, the building serviced by the HVAC system may include ductwork with a variety of ducts having various sizes (e.g., cross-sectional areas and/or cross-sectional geometries), for example. Accordingly, multiple different diffuser assemblies may be manufactured that include dedicated or particularly-designed inlets configured to receive and couple to corresponding types (e.g., sizes) of ducts. That is, various different types of diffuser assemblies may be manufactured to accommodate and enable installation of the diffuser assemblies onto ducts having various sizes or other characteristics. Unfortunately, manufacturing multiple different diffuser assemblies that are each configured for installation on a particular size and/or shape of duct may increase costs of manufacture of the diffuser assemblies, increase storage costs associated with maintaining a relatively large quantity or inventory of different diffuser assemblies (e.g., prior to installation of the diffuser assemblies on a jobsite), and/or complicate selection and installation of the diffuser assemblies at a jobsite.

It is presently recognized that enabling an individual diffuser assembly to couple (e.g., fluidly couple, mechanically couple) to multiple different types (e.g., sizes) of ducts may facilitate improved installation of the diffuser assembly at a jobsite, as well as reduce cost and/or complexity that may be associated with manufacturing and offering the diffuser assembly. Accordingly, embodiments of the present disclosure are directed toward an adjustable diffuser assembly that is configured to couple to multiple different types (e.g., sizes) of ducts. For example, the adjustable diffuser assembly may include a housing having a passage that extends through a wall of the housing. The adjustable diffuser assembly may include a set (e.g., one or more) of adjustment panels that are moveably (e.g., slideably) coupled to the wall of the housing and include a set of flanges that extend into the passage. The flanges may define at least a portion of an inlet port of the adjustable diffuser assembly. The inlet port may facilitate coupling (e.g., fluidic coupling, mechanical coupling) of the diffuser assembly to a duct or duct outlet. The adjustment panels may, via translation along and relative to the housing of the diffuser assembly, enable adjustment of a size (e.g., a cross-sectional area, a cross-sectional shape) of the inlet port of the diffuser assembly. In particular, the adjustment panels may be adjustable to cause the size of the inlet port to substantially match or correspond with sizes or other characteristics of various different ducts. For example, an operator (e.g., a service technician installing the adjustable diffuser assembly at a jobsite) may transition the adjustment panels to a first configuration on or relative to the housing of the diffuser assembly in which the size of the inlet port formed by the flanges of the adjustment panels is relatively large. In this way, the relatively large inlet port may facilitate coupling of the adjustable diffuser assembly to a duct having a relatively large size. Alternatively, the operator may transition the adjustment panels to a second configuration on or relative to the housing of the diffuser assembly in which the size of the inlet port formed by the flanges of the adjustment panels is relatively small. In this way, the relatively small inlet port may facilitate coupling of the adjustable diffuser assembly to a duct having a relatively small size. As discussed below, it should be understood that the adjustment panels may be transitionable to a plurality of intermediate configurations between the first and second configurations to facilitate coupling of the inlet port to multitudinous different sizes and/or shapes of ducts. In this manner, the adjustable diffuser assembly disclosed herein may be configured to couple to a variety of different types of ducts. These and other features will be described below with reference to the drawings.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by an HVAC system 11 having an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, which includes an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. The HVAC unit 12 may provide a variety of heating and/or cooling functions, such as cooling only, heating only, cooling with electric heat, cooling with dehumidification, cooling with gas heat, or cooling with a heat pump. For example, in certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

In any case, after the HVAC unit 12 conditions the air, the air may be supplied to the building 10 via ductwork 14 (e.g., an air distribution system) extending from the HVAC unit 12 and throughout the building 10. For example, the ductwork 14 may extend to various individual floors, rooms zones, or other sections or spaces of the building 10. In the illustrated embodiment, a plurality of diffuser assemblies 16 is coupled to the ductwork 14. The diffuser assemblies 16 may direct the conditioned air into the various spaces of the building 10 in a manner that improves air distribution and/or air dispersion across the spaces.

In some embodiments, a control device 18, one type of which may be a thermostat, may be used to designate the temperature of the conditioned air supplied by the HVAC unit 12. The control device 18 also may be used to control the flow of air through the ductwork 14. For example, the control device 18 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of supply air, return air, and so forth. Moreover, the control device 18 may include computer systems that are integrated with or separate from other building control or monitoring systems, and even systems that are remote from the building 10.

Figure 2:
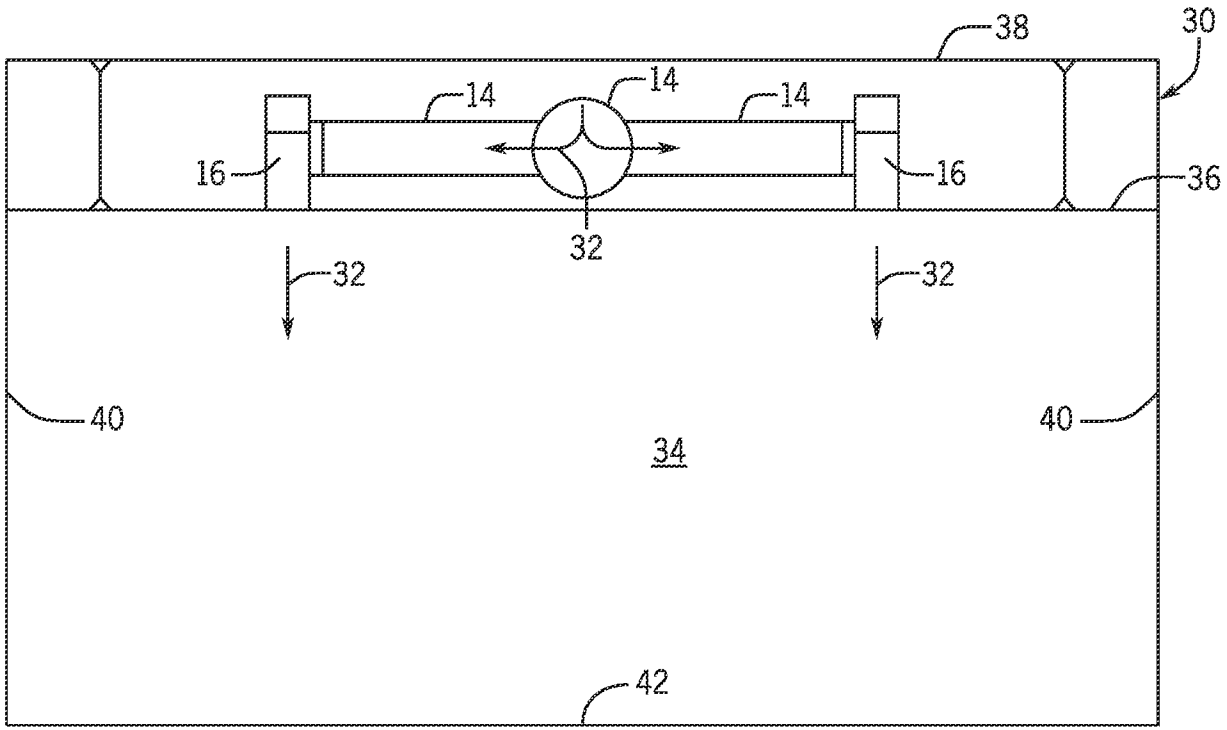
FIG. 2 is a schematic of an embodiment of a room of a building having diffuser assemblies, in accordance with an aspect of the present disclosure.

FIG. 2 is a schematic of an embodiment of a room 30 of the building 10, illustrating diffuser assemblies 16 coupled to ductwork 14. The diffuser assemblies 16 may be fluidly coupled to the ductwork 14 to receive a flow of conditioned air 32, which may generated by the HVAC unit 12, for example. The diffuser assemblies 16 are also fluidly coupled to the room 30. Accordingly, the diffuser assemblies 16 may discharge the conditioned air 32 into a space 34 of the room 30. In some embodiments, the building 10 may include a dropped ceiling 36 (e.g., ceiling tiles) that may be suspended from a ceiling structure 38 of the building 10. At least a portion of the ductwork 14 and the diffuser assemblies 16 may be located in a space formed between the ceiling structure 38 and the dropped ceiling 36. In other embodiments, the ductwork 14 and/or the diffuser assemblies 16 may be located in any other suitable region of the building 10. For example, the ductwork 14, the diffuser assemblies 16, or both, may be partially or fully integrated into the ceiling structure 38 of the building 10 and/or located in walls 40 or a floor 42 of the building 10.

Figure 3:
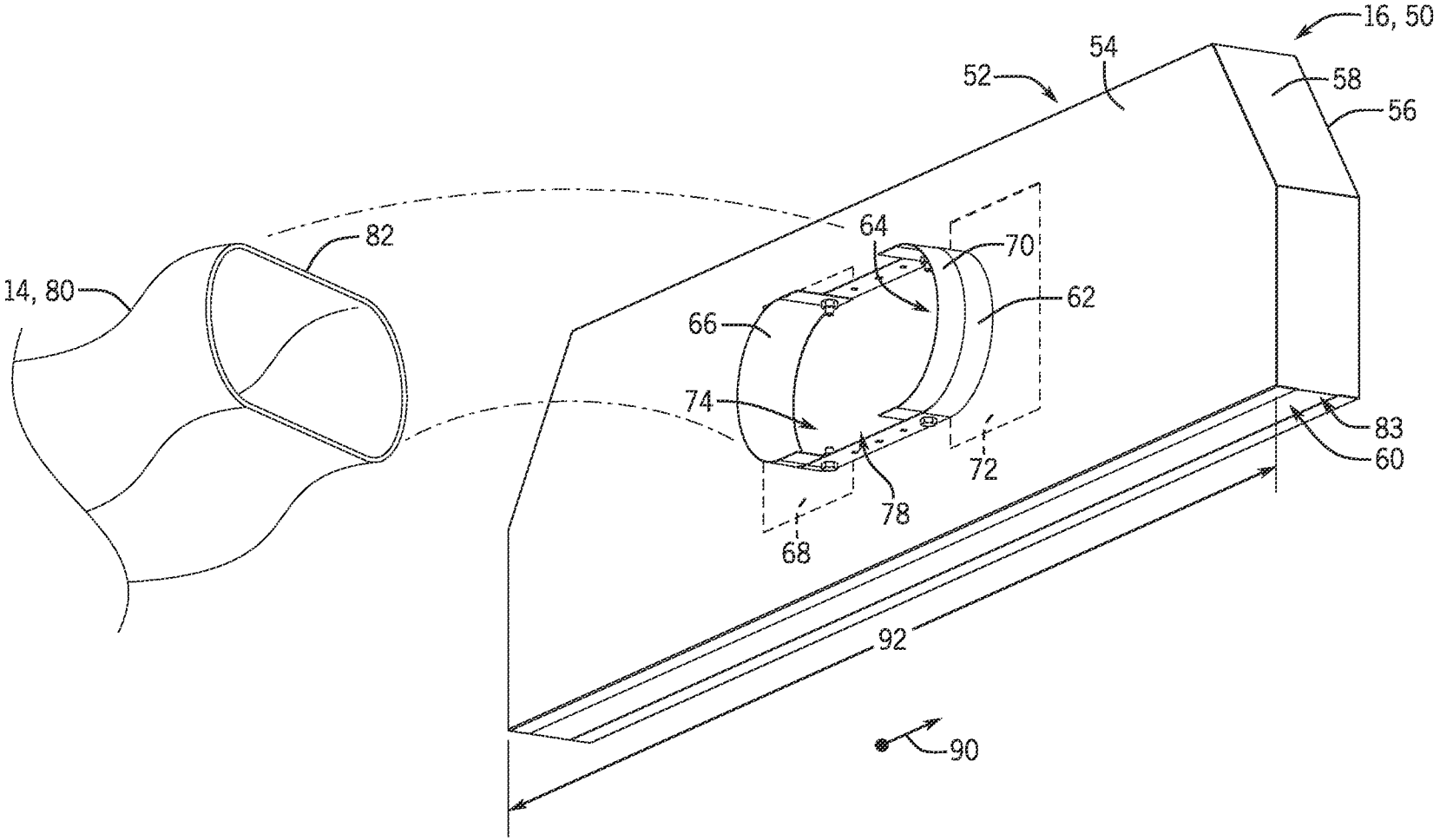
FIG. 3 is a perspective view of an embodiment of a diffuser assembly, in accordance with an aspect of the present disclosure.

FIG. 3 is a perspective view of an embodiment of one of the diffuser assemblies 16, referred to herein as a diffuser assembly 50 (e.g., an adjustable diffuser assembly). In the illustrated embodiment, the diffuser assembly 50 includes a housing 52 having a first wall 54 (e.g., a front wall), a second wall 56 (e.g., a rear wall), and a web 58 (e.g., lateral wall, lateral sides, wrap, etc.) that extends between (e.g., from and to) the first wall 54 and the second wall 56. The first wall 54, the second wall 56, and the web 58 may collectively define an interior volume 60 of the diffuser assembly 50. As discussed in detail below, the first wall 54 may include a wall flange 62 extending therefrom and defining a passage 64 through the first wall 54 and into the interior volume 60 of the housing 52. The passage 64 is configured to receive a first flange 66 of a first adjustment panel 68 (e.g., a first adjustable panel) of the diffuser assembly 50 and to receive a second flange 70 of a second adjustment panel 72 (e.g., a second adjustable panel) of the diffuser assembly 50. The first flange 66 and the second flange 70 may define at least a portion of an inlet port 74 of the diffuser assembly 50. That is, in some embodiments, an inner perimeter 78 of the inlet port 74 may be defined by the first flange 66, the second flange 70, and portions of the wall flange 62, for example.

A duct 80 of the ductwork 14 may include an end portion 82 (e.g., duct outlet) that is configured to extend into, extend about, couple to, or otherwise be fluidly connected to the inlet port 74. In particular, the end portion 82 may be configured to couple to the first flange 66 of the first adjustment panel 68, the second flange 70 of the second adjustment panel 72, the wall flange 62, or a combination thereof. As such, the duct 80 may direct a conditioned air flow (e.g., a cooled air flow, a heated air flow, a dehumidified air flow) that may be generated by the HVAC unit 12, for example, through the inlet port 74 and into the interior volume 60 of the housing 52. The housing 52 may discharge the conditioned air flow received from the duct 80 via an outlet port 83 of the housing 52, which may be formed between the first wall 54 and the second wall 56. In an installed configuration, the outlet port 83 may be exposed to or otherwise fluidly coupled to the space 34 of the room 30. In this manner, the diffuser assembly 50 may facilitate distribution and/or dispersion of the conditioned air flow received from the duct 80 into the space 34 of the room 30, for example.

As discussed in detail below, the first adjustment panel 68 and the second adjustment panel 72 may be moveably coupled to the housing 52 and configured to translate along the first wall 54 (e.g., relative to the housing 52) toward one another and/or away from one another. In particular, the first adjustment panel 68 and the second adjustment panel 72 may translate along an axis 90, relative to the first wall 54, where the axis 90 may extend generally parallel to a width 92 of the housing 52. In this manner, cooperative adjustment of the first adjustment panel 68 and the second adjustment panel 72 along and relative to the first wall 54 enables adjustment of a size (e.g., a cross-sectional area, a cross-sectional shape) of the inlet port 74. In particular, adjustment of the first and second adjustment panels 68, 72 along the first wall 54 enables a size of the inlet port 74 to be increased or decreased to enable the inlet port 74 to adequately receive the end portion 82 of the duct 80, based on the particular size of the duct 80 (e.g., a relatively large or wider duct 80, a relative small or narrow duct 80).

Accordingly, in embodiments where the duct 80 has a size that is relatively large, the first adjustment panel 68 and the second adjustment panel 72 may be transitioned to a first configuration 96 (see FIG. 8), in which the first flange 66 of the first adjustment panel 68 and the second flange 70 of the second adjustment panel 72 are positioned at opposing sides or edges of the passage 64 (e.g., with respect to the axis 90), such that the inlet port 74 is relatively large and configured to receive and secure the relatively large duct 80. Conversely, in embodiments where the duct 80 has a size that is relatively small, the first adjustment panel 68 and the second adjustment panel 72 may be transitioned to a second configuration 98 (see FIG. 11), in which the first flange 66 of the first adjustment panel 68 and the second flange 70 of the second adjustment panel 72 are engaged with or abutting one another or positioned substantially adjacent one another (e.g., with respect to the axis 90), such that the inlet port 74 is relatively small and configured to receive and secure the relatively small duct 80. As such, it should be appreciated that adjustment of the size of the inlet port 74 may facilitate coupling the diffuser assembly 50 to various different sizes of the duct 80. As discussed below, the first adjustment panel 68 and the second adjustment panel 72 may be transitioned to a plurality of configurations between the first configuration 96 and the second configuration 98, such that the first flange 66 of the first adjustment panel 68, the second flange 70 of the second adjustment panel 72, and corresponding portions of the wall flange 62 may cooperate to adjust the size of the inlet port 74 to a plurality of different values.

Figure 4:
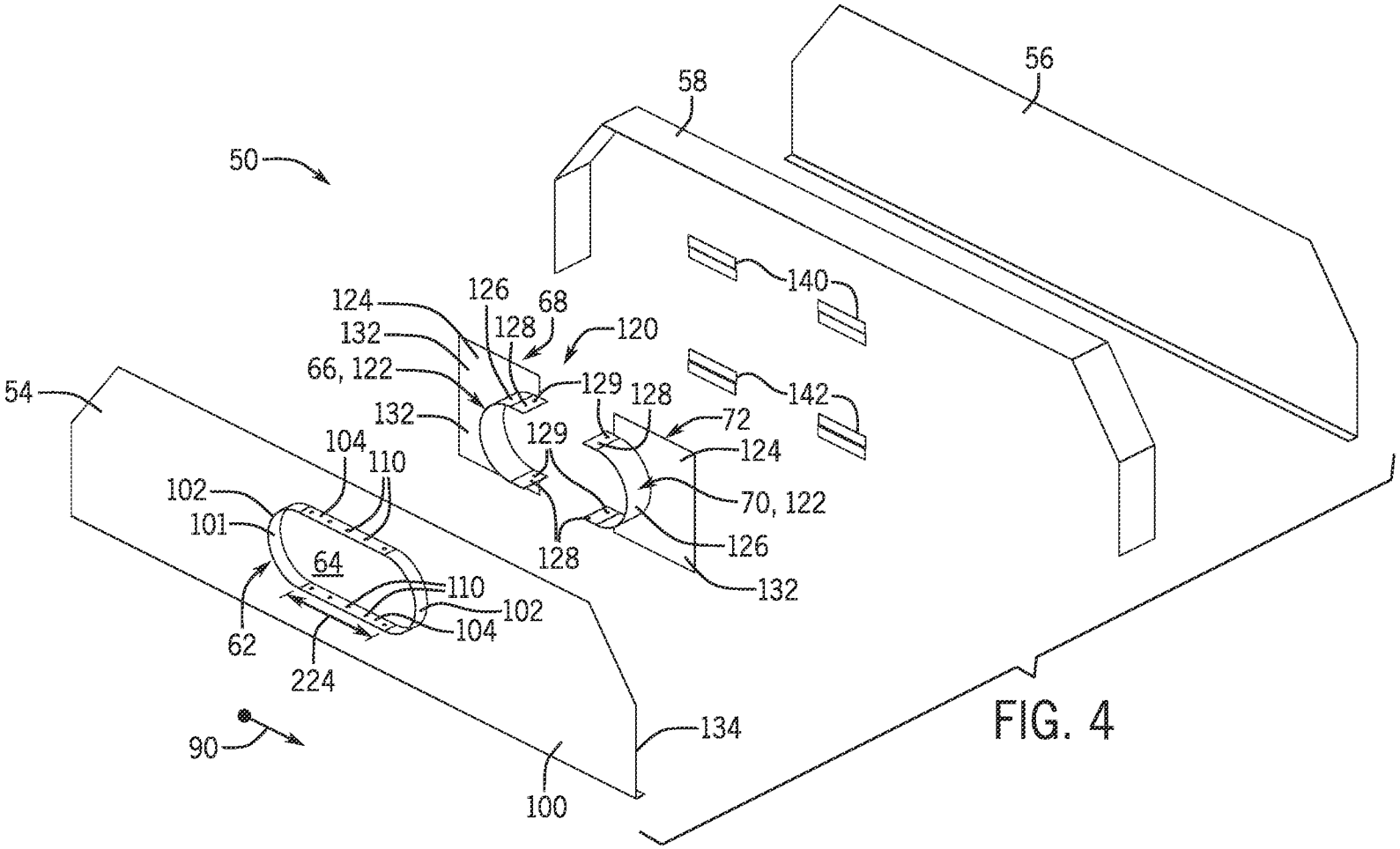
FIG. 4 is an exploded perspective view of an embodiment of a diffuser assembly, in accordance with an aspect of the present disclosure.

FIG. 4 is an exploded perspective view of an embodiment of the diffuser assembly 50. In some embodiments, the first wall 54, the second wall 56, and the web 58 of the housing 52 may be separate components that are coupled to one another via fasteners, adhesives, and/or a metallurgical process, such as welding or brazing. In some embodiments, the wall flange 62 that may extend from and cross-wise to an outer surface 100 of the first wall 54. The wall flange 62 may define an inner perimeter 101 of the passage 64. For example, in the illustrated embodiment, the wall flange 62 includes a set of profiled flange sections 102 (e.g., lateral flange sections, curved flange sections) and a set of flange mounting sections 104 (e.g., linear flange sections) that extend between the profiled flange sections 102. As such, profiled flange sections 102 and the flange mounting sections 104 may collectively define the inner perimeter 101 of the passage 64.

In some embodiments, the flange mounting sections 104 may extend generally parallel to one another and along the axis 90, for example. Either or both of the flange mounting sections 104 may include one or more first apertures 110 formed therein that, as discussed below, may be configured to facilitate securement of the first adjustment panel 68 and the second adjustment panel 72 to the first wall 54 at plurality of discrete positions. In some embodiments, each of the profiled flange sections 102 may be self-similar and have a semi-circular profile that extends between corresponding ends of the flange mounting sections 104. To this end, the inner perimeter 101 of the passage 64 may include a generally oblong profile. However, although the passage 64 is illustrated as having a generally oblong cross-sectional profile in the illustrated embodiment of FIG. 4, it should be appreciated that, in other embodiments, the passage 64 may have any other suitable cross-sectional profile. For example, in some embodiments, the profiled flange sections 102 may be linear sections that extend between the flange mounting sections 104 to form a quadrilateral cross-sectional profile of the passage 64, a trapezoidal cross-sectional profile of the passage 64, or another suitable cross-sectional profile of the passage 64. In certain embodiments, the wall flange 62 may be a component that is separate from the first wall 54 and coupled to the first wall 54 (e.g., via a metallurgical process). In other embodiments, the wall flange 62 may be formed integrally with the first wall 54. For example, the first wall 54 may be formed from sheet metal that is stamped to include the wall flange 62 formed integrally therewith.

For conciseness, the first adjustment panel 68 and the second adjustment panel 72 may be collectively referred to herein as adjustment panels 120 of the diffuser assembly 50. In some embodiments, the first adjustment panel 68 and the second adjustment panel 72 may be self-similar components that are interchangeable with one another. Moreover, the first flange 66 of the first adjustment panel 68 and the second flange 70 of the second adjustment panel 72 may be collectively referred to herein as adjustment panel flanges 122. In the illustrated embodiment of FIG. 4, the adjustment panels 120 each include a base panel 124 (e.g., a base portion) and the corresponding adjustment panel flanges 122 (e.g., flange portions), which may extend cross-wise to and from the base panels 124. In some embodiments, the adjustment panel flanges 122 may each include a profiled portion 126 (e.g., a curved portion) and a set of mounting portions 128 (e.g., linear portions) that extend from the profiled portion 126. The mounting portions 128 may include one or more second apertures 129 formed therein that, as discussed below, may be configured to align with corresponding ones of the first apertures 110 to facilitate securement of the first adjustment panel 68 and the second adjustment panel 72 to the first wall 54 at plurality of discrete positions along the first wall 54.

In some embodiments, the profiled portions 126 of the adjustment panel flanges 122 may include profiles that match (e.g., are geometrically similar too) or correspond with the profiled flange sections 102 of the wall flange 62. In an installed configuration 130 (see FIG. 5) of the adjustment panels 120 on the first wall 54, first sliding surfaces 132 of the base panels 124 may be configured to engage with (e.g., physically contact) a second sliding surface 134 of the first wall 54, and the adjustment panel flanges 122 may extend through the passage 64. Further, in the installed configuration 130 of the adjustment panels 120 on the first wall 54, the mounting portions 128 of the adjustment panel flanges 122 may extend generally parallel to the flange mounting sections 104 of the wall flange 62.

Figure 5:
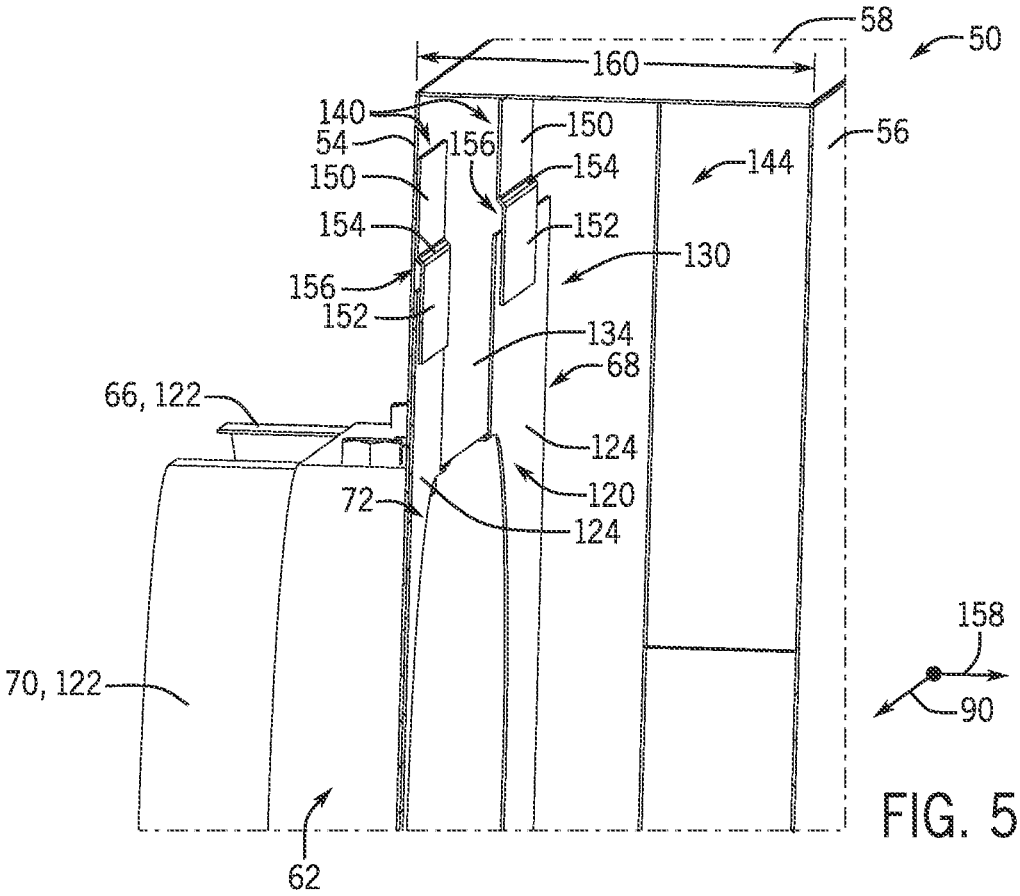
FIG. 5 is a cross-sectional perspective view of an embodiment of a portion of a diffuser assembly, in accordance with an aspect of the present disclosure.

The diffuser assembly 50 includes a plurality of upper guide tabs 140 and a plurality of lower guide tabs 142 that are configured to couple to the first wall 54 and, as discussed below, guide translation of the adjustment panels 120 along the axis 90, relative to the first wall 54. For example, to better illustrate the engagement between the upper guide tabs 140 and the first wall 54, FIG. 5 is a cross-sectional perspective view of an embodiment of a portion of the diffuser assembly 50, illustrating the upper guide tabs 140 in an installed configuration 144 on the first wall 54. For clarity, in the illustrated embodiment of FIG. 5, the adjustment panels 120 are in the installed configuration 130 on the first wall 54. In some embodiments, the upper guide tabs 140 may each include a first mounting flange 150, a first guide flange 152, and a first web 154 (e.g., transition section, offsetting portion) that extends between the first mounting flange 150 and the first guide flange 152. The first mounting flanges 150 may be coupled to the second sliding surface 134 of the first wall 54 in the installed configuration 144 of the upper guide tabs 140. The first mounting flanges 150 may be coupled to the first wall 54 via fasteners, adhesives, or a metallurgical process, such as welding or brazing. In the installed configuration 144 on the first wall 54, the upper guide tabs 140 may form a set of first channels 156 that extend between the second sliding surface 134 of the first wall 54 and corresponding surfaces the first guide flanges 152. Each of the first channels 156 is configured to receive a respective one of the base panels 124 of the adjustment panels 120. In this way, the upper guide tabs 140 may enable translation of the adjustment panels 120 along the first channels 156 and the axis 90, relative to the first wall 54, while substantially blocking movement of the adjustment panels 120 along an additional axis 158 that may extend parallel to a depth 160 of the housing 52, for example. That is, the upper guide tabs 140 may guide translation of the first sliding surfaces 132 (see FIG. 4) of the adjustment panels 120 along the second sliding surface 134 of the first wall 54 (e.g., along the axis 90).

Figure 6:
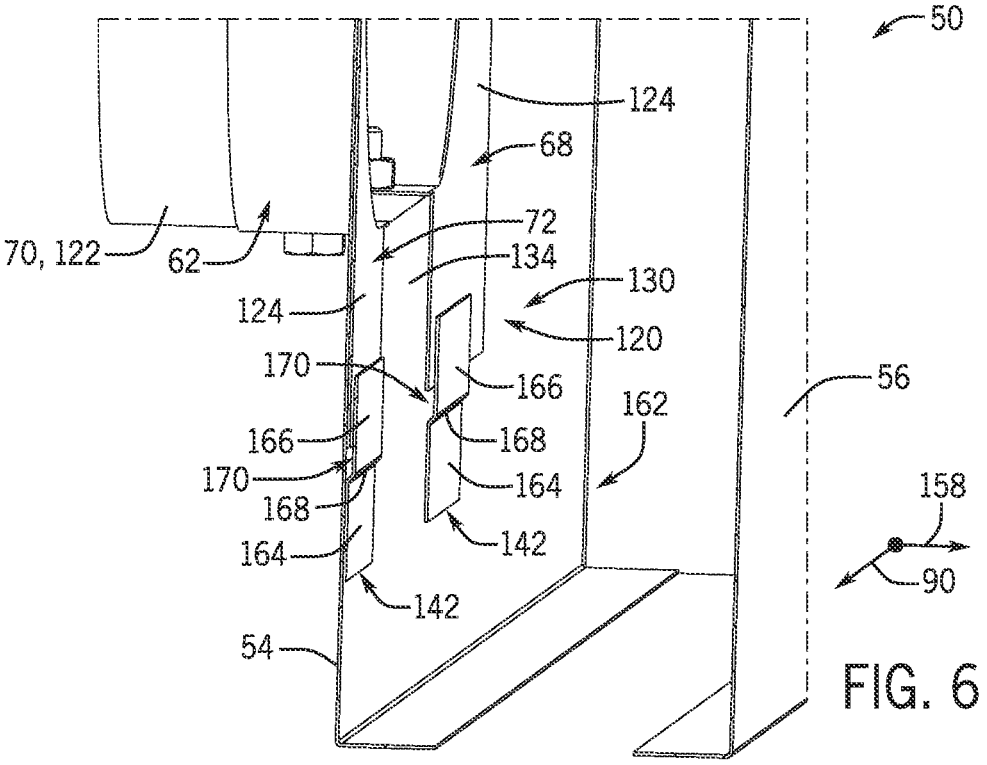
FIG. 6 is a cross-sectional perspective view of an embodiment of a portion of a diffuser assembly, in accordance with an aspect of the present disclosure.

To better illustrate the engagement between the lower guide tabs 142 and the first wall 54, FIG. 6 is a cross-sectional perspective view of an embodiment of a portion of the diffuser assembly 50, illustrating the lower guide tabs 142 in an installed configuration 162 on the first wall 54. For clarity, in the illustrated embodiment of FIG. 6, the adjustment panels 120 are in the installed configuration 130 on the first wall 54. In some embodiments, the lower guide tabs 142 may each include a second mounting flange 164, a second guide flange 166, and a second web 168 (e.g., transition section, offsetting portion) that extends between the second mounting flange 164 and the second guide flange 166. The second mounting flanges 164 may be coupled to the second sliding surface 134 of the first wall 54 in the installed configuration 162 of the lower guide tabs 142. The second mounting flanges 164 may be coupled to the first wall 54 via fasteners, adhesives, or a metallurgical process, such as welding or brazing. In the installed configuration 162 on the first wall 54, the lower guide tabs 142 may form a set of second channels 170 that extend between the second sliding surface 134 of the first wall 54 and corresponding surfaces the second guide flanges 166. Each of the second channels 170 is configured to receive a respective one of the base panels 124 of the adjustment panels 120. Thus, the lower guide tabs 142 may enable translation of the adjustment panels 120 along the second channels 170 and the axis 90, relative to the first wall 54, while substantially blocking movement of the adjustment panels 120 along the additional axis 158, for example. That is, the lower guide tabs 142 may facilitate translation of the first sliding surfaces 132 (see FIG. 4) of the adjustment panels 120 along the second sliding surface 134 of the first wall 54 (e.g., along the axis 90).

Figure 7:
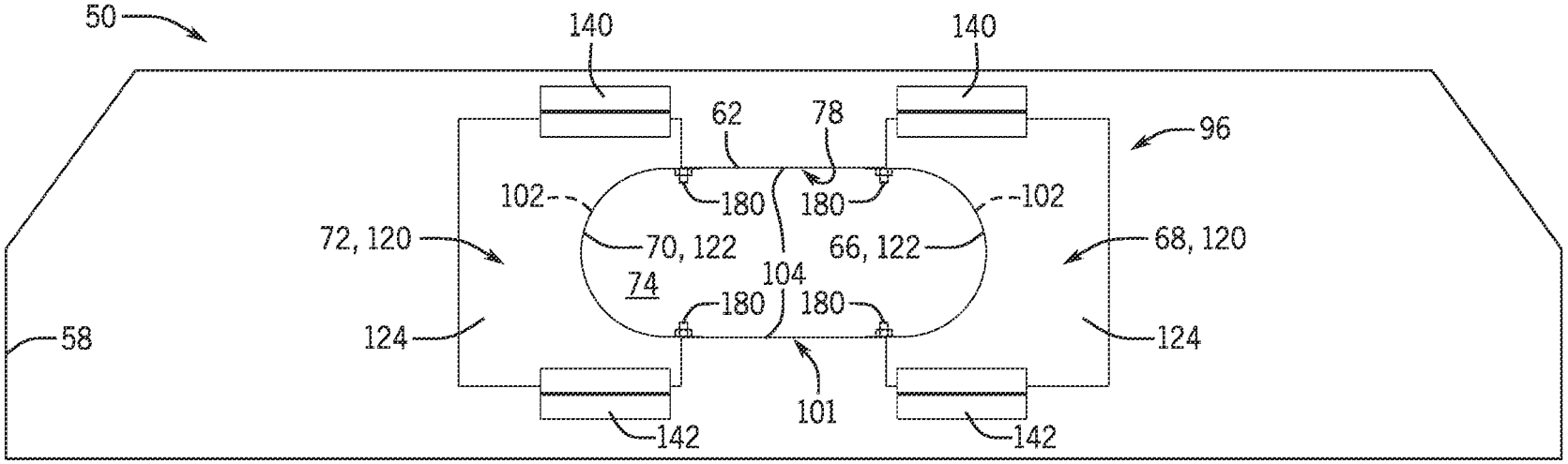
FIG. 7 is an elevation view of an embodiment of a portion of a diffuser assembly having adjustment panels in an open configuration, in accordance with an aspect of the present disclosure.
Figure 8:
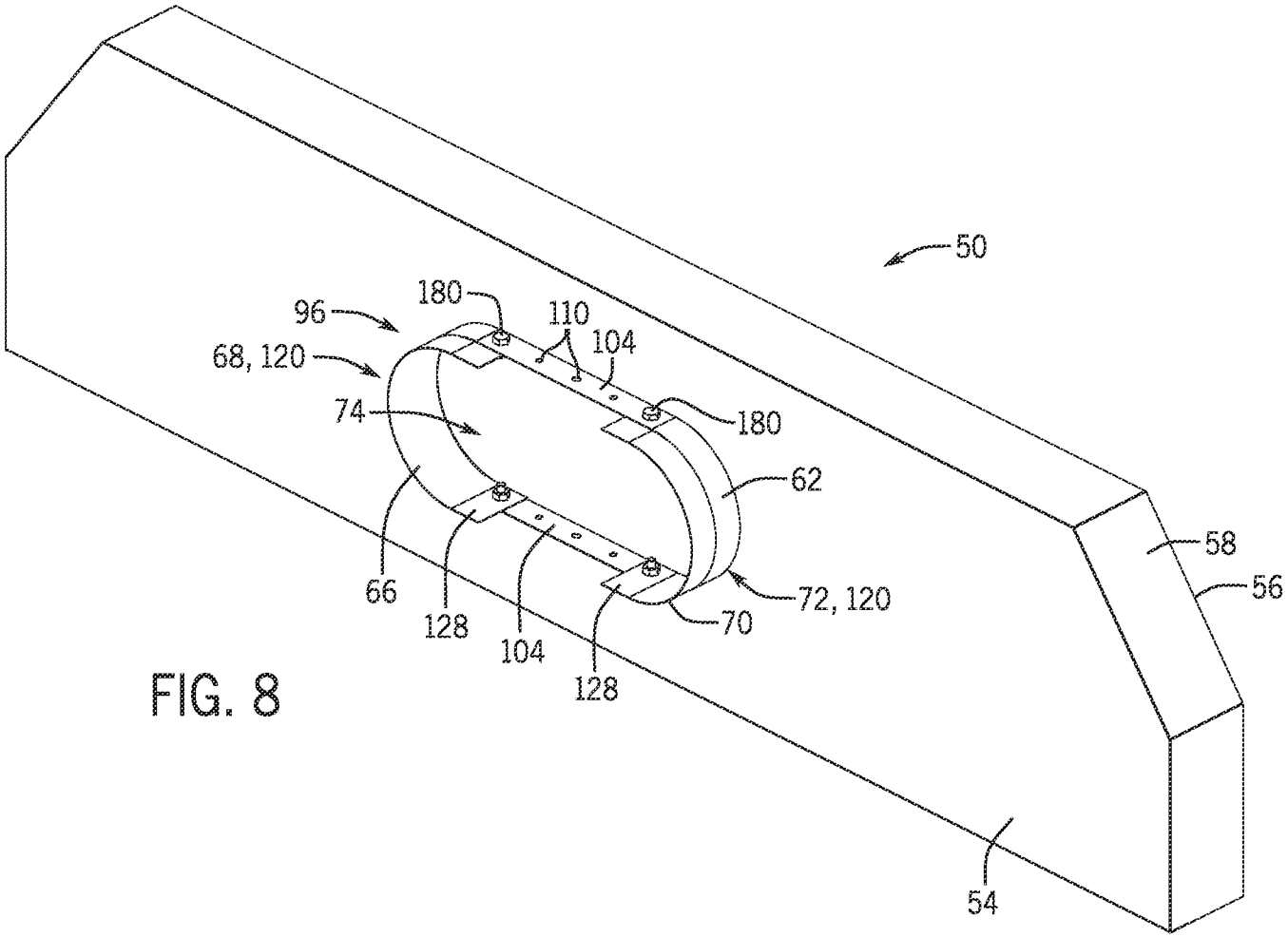
FIG. 8 is perspective view of an embodiment of a diffuser assembly having adjustment panels in an expanded configuration, in accordance with an aspect of the present disclosure.

FIG. 7 is an elevation view of an embodiment of a portion of the diffuser assembly 50, illustrating the adjustment panels 120 in the first configuration 96 (e.g., a fully open or expanded configuration). For clarity, the second wall 56 is not shown with the housing 52 in the illustrated embodiment of FIG. 7 to better illustrate the adjustment panels 120. In the first configuration 96, the adjustment panels 120 may be positioned such that the adjustment panel flanges 122 are engaged with (e.g., physically contact, abut) the wall flange 62. That is, the adjustment panel flanges 122 may engage with the profiled flange sections 102 of the wall flange 62. As generally discussed above, the inner perimeter 78 of the inlet port 74 may be defined by inner surfaces of the adjustment panel flanges 122 and inner surfaces of at least a portion of the flange mounting sections 104. As such, in the first configuration 96 (e.g., an expanded configuration) of the adjustment panels 120, the inner perimeter 78 of the inlet port 74 may be relatively large and substantially equal to the inner perimeter 101 of the wall flange 62, for example. In certain embodiments, one or more fasteners 180 may extend through corresponding ones of the first apertures 110 in the wall flange 62 and the second apertures 129 in the adjustment panel flanges 122 to couple the adjustment panels 120 to the first wall 54 at the first configuration 96. In other embodiments, the adjustment panels 120 may be coupled to the first wall 54 at the first configuration 96 via any other suitable technique. In any case, while the adjustment panels 120 are in the first configuration 96, the inlet port 74 may include a relatively large size and, thus, be configured to receive and secure a relatively large duct 80. That is, in the first configuration 96, a cross-sectional area of the inlet port 74 may be substantially equal to a cross-sectional area of the passage 64. To further illustrate the engagement between the fasteners 180 and the apertures 110, 129 in the first configuration 96 of the adjustment panels 120, FIG. 8 is a perspective view of an embodiment of the diffuser assembly 50, in which the adjustment panels 120 are coupled to the first wall 54 (e.g., via the fasteners 180) in the first configuration 96.

Figure 9:
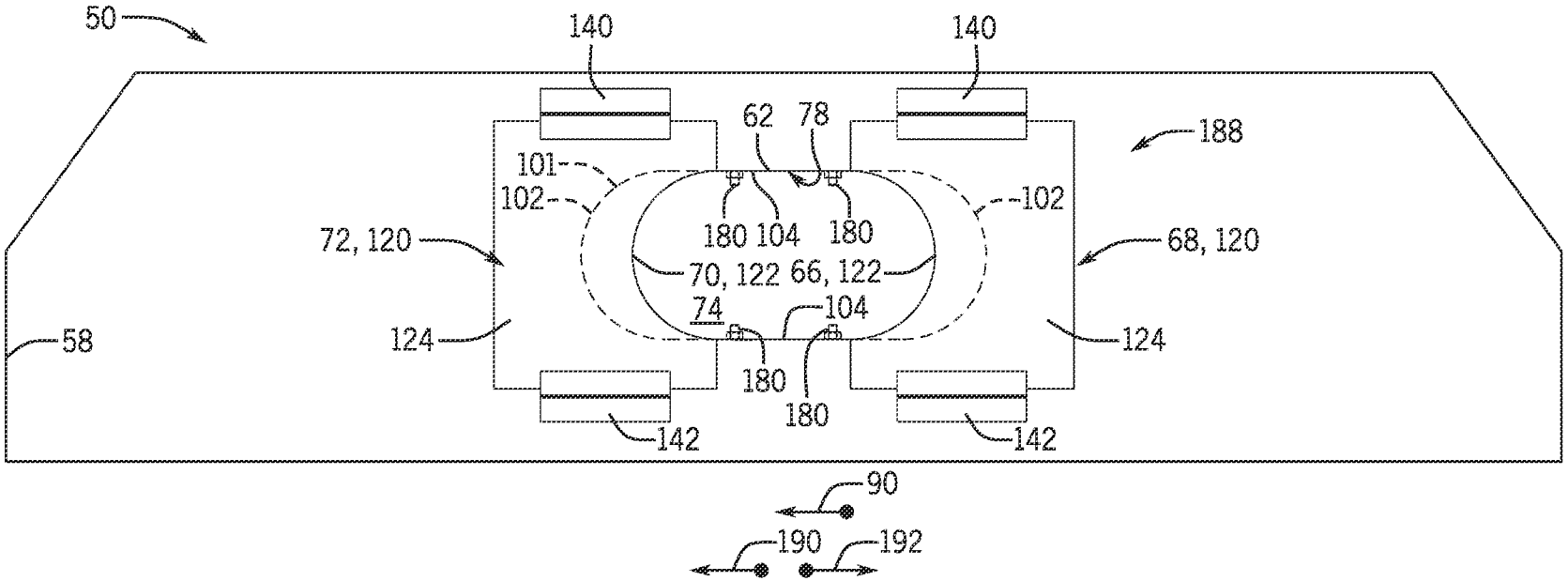
FIG. 9 is an elevation view of an embodiment of a portion of a diffuser assembly having adjustment panels in an intermediate configuration, in accordance with an aspect of the present disclosure.

FIG. 9 is an elevation view of an embodiment of a portion of the diffuser assembly 50, illustrating the adjustment panels 120 in an intermediate configuration 188. For clarity, the second wall 56 is not shown with the housing 52 in the illustrated embodiment of FIG. 9 to better illustrate the adjustment panels 120. To transition the adjustment panels 120 from the first configuration 96 to the intermediate configuration 188, an operator (e.g., a service technician installing the diffuser assembly 50 at a jobsite) may slide the first adjustment panel 68 in a first direction 190 along the axis 90 and slide the second adjustment panel 72 in a second direction 192 along the axis 90, opposite the first direction 190. In particular, the operator may slide the adjustment panels 120 along the axis 90 until selected apertures 110, 129 are appropriately aligned to enable insertion of the fasteners 180 and coupling of the adjustment panels 120 to the first wall 54 at the intermediate configuration 188. As such, while the adjustment panels 120 are in the intermediate configuration 188, the inlet port 74 may include a moderate size and, thus, be configured to receive and secure a moderately-sized duct 80. That is, in the intermediate configuration 188, a cross-sectional area of the inlet port 74 may be less than a cross-sectional area of the passage 64. Indeed, as shown in the illustrated embodiment, in the intermediate configuration 188 of the adjustment panels 120, the base panels 124 may occlude at least a portion of the passage 64 to block undesired air flow between the adjustment panels 120 and the first wall 54.

Figure 10:
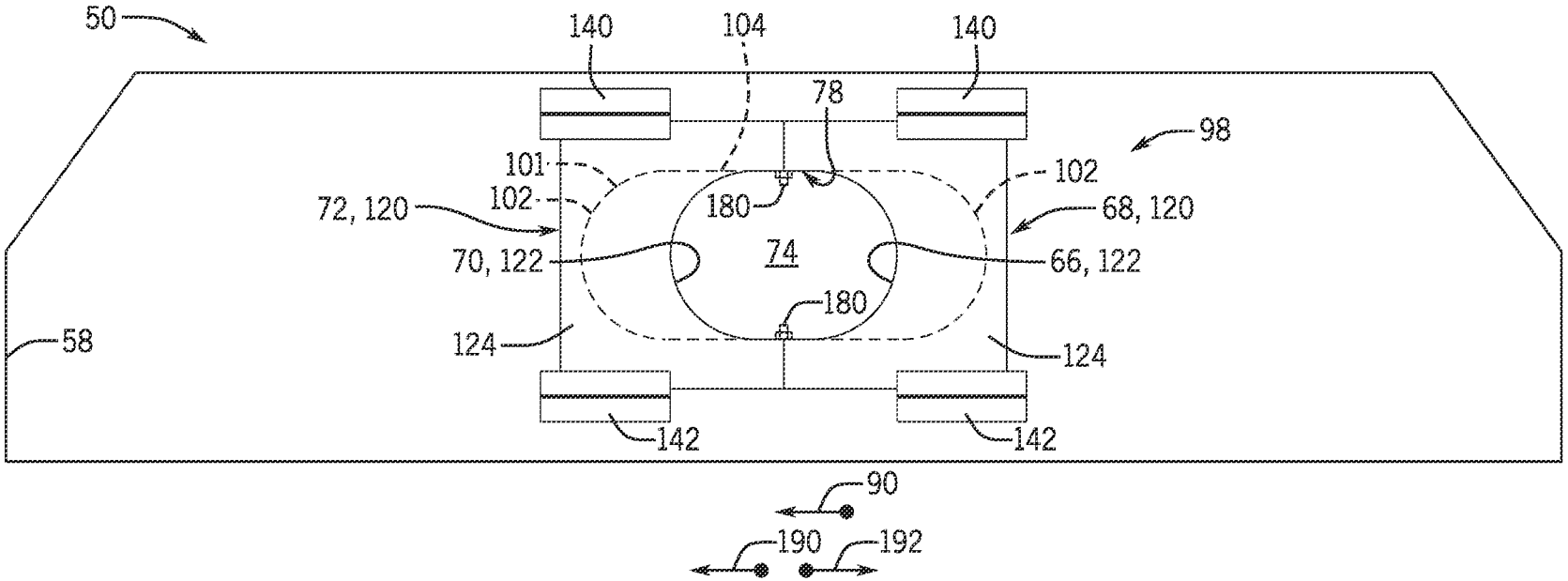
FIG. 10 is an elevation view of an embodiment of a portion of a diffuser assembly having adjustment panels in a contracted configuration, in accordance with an aspect of the present disclosure.
Figure 11:
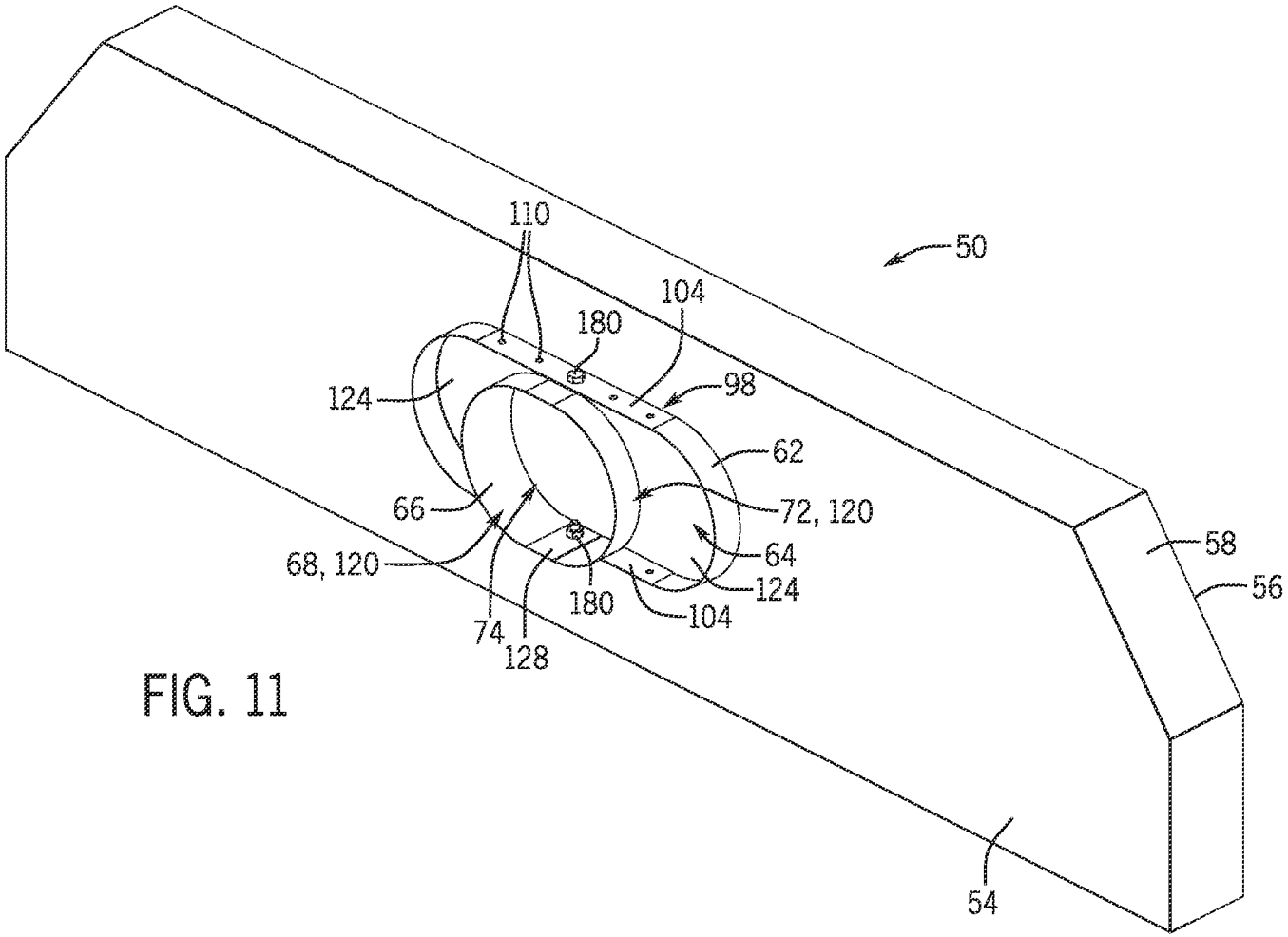
FIG. 11 is perspective view of an embodiment of a diffuser assembly having adjustment panels in a contracted configuration, in accordance with an aspect of the present disclosure.

FIG. 10 is an elevation view of an embodiment of a portion of the diffuser assembly 50, illustrating the adjustment panels 120 in the second configuration 98 (e.g., a contracted configuration). For clarity, the second wall 56 is not shown with the housing 52 in the illustrated embodiment of FIG. 10 to better illustrate the adjustment panels 120. To transition the adjustment panels 120 from the intermediate configuration 188 to the second configuration 98, the operator may slide the first adjustment panel 68 in the first direction 190 along the axis 90 and slide the second adjustment panel 72 in the second direction 192 along the axis 90, opposite the first direction 190. In particular, the operator may slide the adjustment panels 120 along the axis 90 until selected apertures 110, 129 are appropriately aligned to enable insertion of the fasteners 180 and coupling of the adjustment panels 120 to the first wall 54 at the second configuration 98. In some embodiments, the first adjustment panel 68 may engage (e.g., contact, abut) the second adjustment panel 72 in the second configuration 98 of the adjustment panels 120. In any case, while the adjustment panels 120 are in the second configuration 98, the inlet port 74 may include a relatively small size and, thus, be configured to receive and secure a relatively small duct 80. That is, in the second configuration 98, a cross-sectional area of the inlet port 74 may be less than a cross-sectional area of the passage 64. Indeed, as shown in the illustrated embodiment, the base panels 124 may occlude at least a portion of the passage 64 in the second configuration 98 of the adjustment panels 120 to block undesired air flow between the adjustment panels 120 and the first wall 54. To further illustrate the engagement between the fasteners 180 and the apertures 110, 129 in the second configuration 98 of the adjustment panels 120, FIG. 11 is a perspective view of an embodiment of the diffuser assembly 50, in which the adjustment panels 120 are coupled to the first wall 54 (e.g., via the fasteners 180) in second configuration 98.

Figure 12:
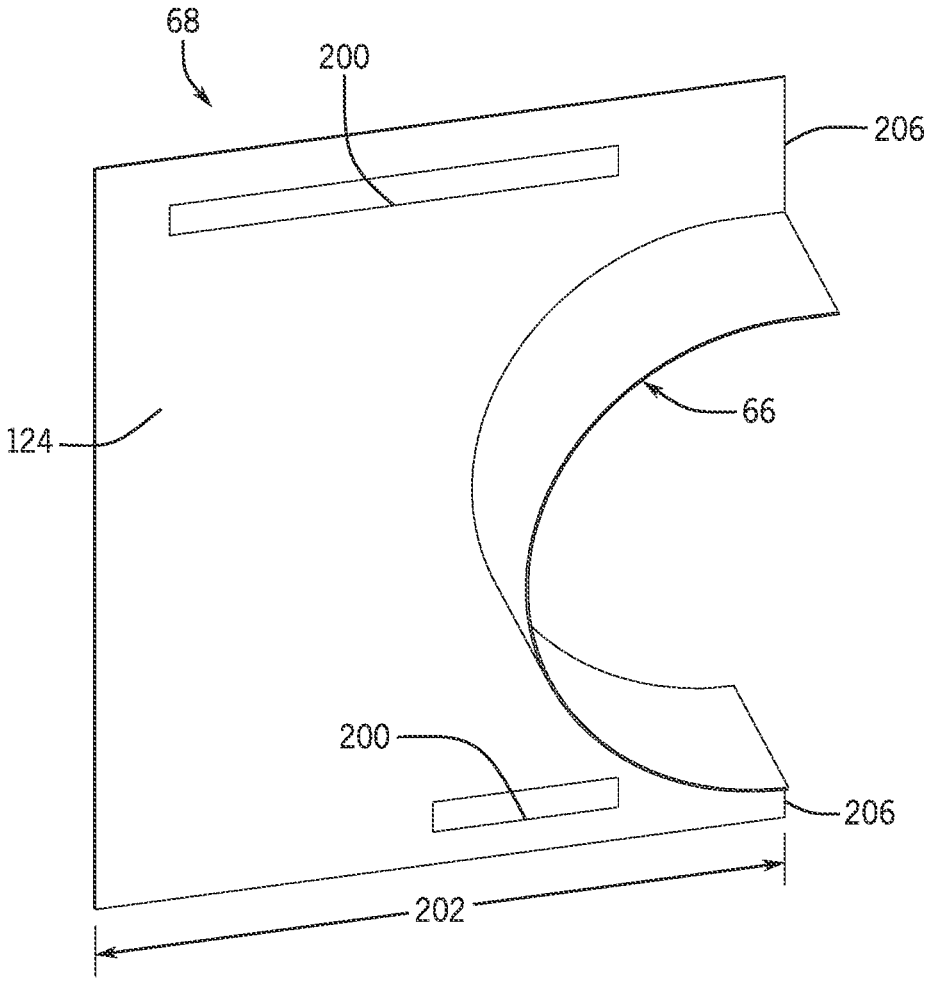
FIG. 12 is a perspective view of an embodiment of an adjustment panel of a diffuser assembly, in accordance with an aspect of the present disclosure.

FIG. 12 is a perspective view of an embodiment of the first adjustment panel 68, illustrating a set of mounting slots 200 of the first adjustment panel 68. As discussed below, the mounting slots 200 may be configured to receive fasteners to facilitate coupling of the first adjustment panel 68 to the housing 52 at a plurality of user-selectable positions. The mounting slots 200 may extend through the base panel 124 and along a width 202 of the first adjustment panel 68. In the illustrated embodiment of FIG. 12, the first adjustment panel 68 does not include the mounting portions 128. Indeed, as discussed below, the mounting slots 200 may be used to facilitate coupling (e.g., fixed coupling) of the first adjustment panel 68 to the housing 52 in lieu of the mounting portions 128. As such, in the illustrated embodiment, distal ends of the first flange 66 may terminate at an edge 206 of the base panel 124. However, it should be appreciated that, in other embodiments, the first adjustment panel 68 may include both the mounting slots 200 and the mounting portions 128. Moreover, it should be understood that the second adjustment panel 72 may include some of or all of the features of the first adjustment panel 68 discussed herein.

Figure 13:
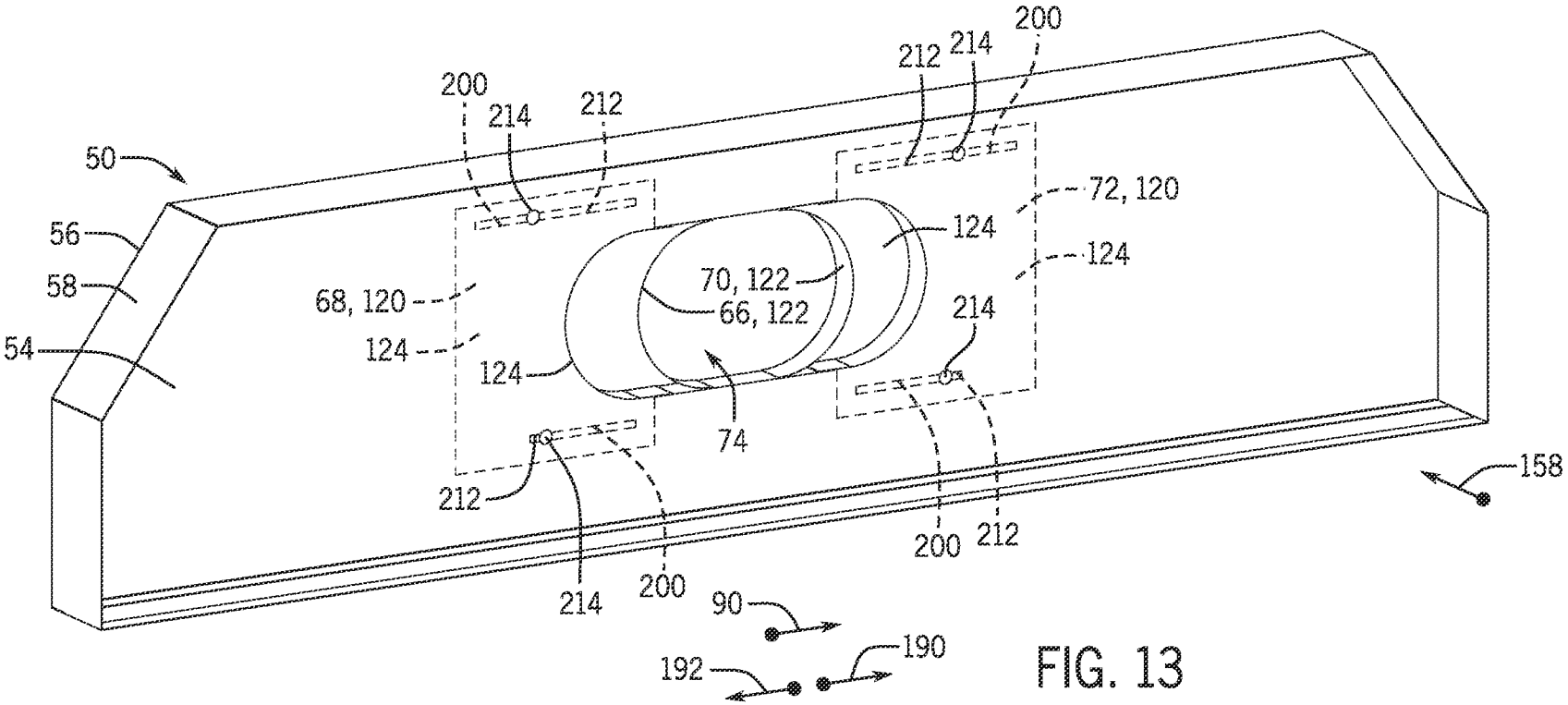
FIG. 13 is a perspective view of an embodiment of a diffuser assembly, in accordance with an aspect of the present disclosure.

FIG. 13 is a perspective view of an embodiment of the diffuser assembly 50, in which the first adjustment panel 68 and the second adjustment panel 72 each include corresponding mounting slots 200. The diffuser assembly 50 may include a plurality of apertures 212 formed in the first wall 54 of the housing 52. The apertures 212 may each be configured to align with a corresponding one of the mounting slots 200 formed in the first and second adjustment panels 68, 72. Fasteners 214 may extend through the apertures 212 and through a corresponding one of the mounting slots 200. Retention features (e.g., nuts) may be coupled to ends of the fasteners 214 to wedge or capture the base panels 124 between the retention features and the second sliding surface 134 of the first wall 54. For example, in some embodiments, the retention features may be adjusted such that the engagement between the retention features and the fasteners 214 applies a slight compressive force between the second sliding surface 134 of the first wall 54 and the base panels 124, while still enabling translation of the first and second adjustment panels 68, 72 along the first wall 54 in the first or second directions 190, 192 (e.g., based on a force applied to the first and/or second adjustment panels 68, 72 by the operator). Moreover, in this manner, engagement between the fasteners 214 and the mounting slots 200 may enable translation of the first adjustment panel 68 and the second adjustment panel 72 along the axis 90, relative to the housing 52, while substantially blocking movement of the first and second adjustment panels 68, 72 along the additional axis 158, relative to the housing 52. As such, in some embodiments, the upper guide tabs 140 and the lower guide tabs 142 may be omitted from the diffuser assembly 50.

In any case, during, for example, installation of the diffuser assembly 50, the operator may slide (e.g., independently slide) the first and second adjustment panels 68, 72 along the housing 52 until the inlet port 74 reaches a size (e.g., cross-sectional area, cross-sectional shape) that is suitable to receive and secure the duct 80. Once the first and second adjustment panels 68, 72 are positioned in a manner that enables the inlet port 74 to adequately receive and couple to the duct 80, the operator may tighten the retention features on the fasteners 214 to fixedly couple the first and second adjustment panels 68, 72 to the housing 52 and block further or undesired movement of the first and second adjustment panels 68, 72 relative to the housing 52.

Figure 14:
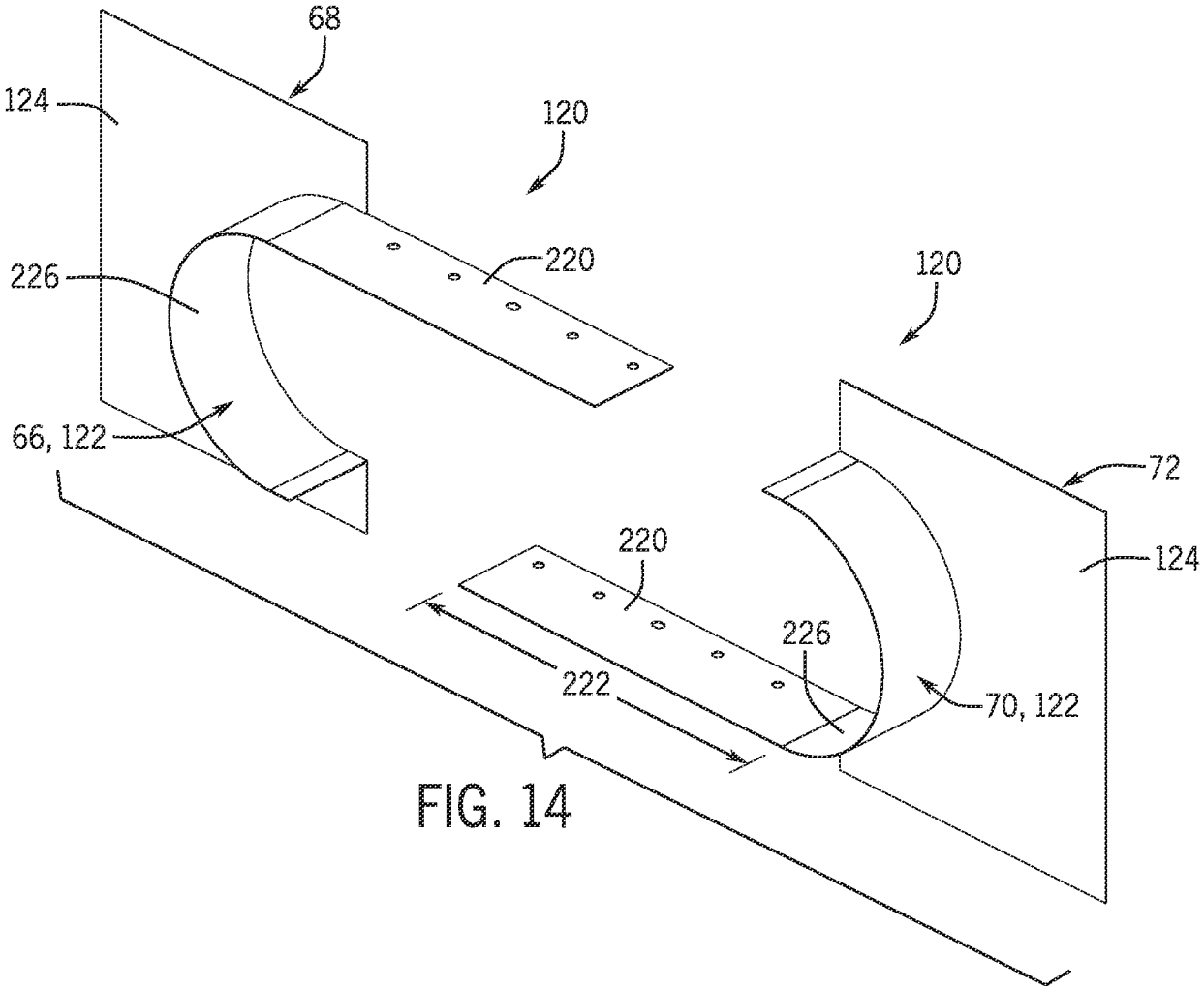
FIG. 14 is a perspective view of an embodiment of adjustment panels of a diffuser assembly, in accordance with an aspect of the present disclosure.

FIG. 14 is a perspective view of another embodiment of the adjustment panels 120, in which the adjustment panels 120 each include a single mounting portion 128, referred to herein as an extended mounting portion 220. In some embodiments, each of the extended mounting portions 220 may include a length 222 that is substantially equal to a length 224 (see FIG. 4) of each of the flange mounting sections 104. As such, when the adjustment panels 120 are installed on the first wall 54 and disposed in the first configuration 96, the extended mounting portions 220 may extend across the lengths 224 of the flange mounting sections 104 and may be coupled to the flange mounting sections 104 in accordance with the aforementioned techniques. Upon transitioning the adjustment panels 120 from the first configuration 96 toward the second configuration 98, the extended mounting portions 220 may engage with corresponding inner surfaces 226 of the adjustment panel flanges 122 and translate along the inner surfaces 226. In certain embodiments, upon transitioning the adjustment panels 120 to an appropriate or desired position on the first wall 54, the operator may trim (e.g., cut shear) any portion of the extended mounting portions 220 that may overlap with the inner surfaces 226 from the first and/or second adjustment panels 68, 72 (e.g., using tin shears). It should be appreciated that, in certain embodiments, the first adjustment panel 68, the second adjustment panel 72, or both, may include the mounting slots 200 in addition to the extended mounting portions 220. As such, the first or second adjustment panels 68, 72 may be coupled to the housing 52 in accordance with the techniques discussed above.

As set forth above, embodiments of the present disclosure may provide one or more technical effects useful for coupling (e.g., fluidly coupling, mechanically coupling) an individual diffuser assembly to multiple different types of ducts to facilitate installation of the diffuser assembly at a jobsite, as well as reduce costs and/or complexity that may be associated with manufacturing the diffuser assembly. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A diffuser assembly for a heating, ventilation, and air conditioning (HVAC) system, the diffuser assembly comprising:

a housing comprising a wall and a passage formed in the wall;

a first adjustment panel moveably coupled to the wall and comprising a first flange; and a second adjustment panel moveably coupled to the wall and comprising a second flange, wherein the first flange and the second flange define at least a portion of an inlet port of the diffuser assembly that extends through the passage, wherein the inlet port is configured to fluidly couple to a duct and direct an air flow from the duct into an interior volume of the housing, and wherein the first adjustment panel and the second adjustment panel are configured to translate along the wall to adjust a size of the inlet port, wherein the wall comprises a mounting section extending from a surface of the wall and forming a portion of a perimeter of the passage, wherein the first flange comprises a mounting portion, and wherein the mounting portion of the first flange is configured to couple to the mounting section of the wall to secure the first adjustment panel to the wall.

2. The diffuser assembly of claim 1, wherein the first adjustment panel comprises a first base portion having a first sliding surface, the second adjustment panel comprises a second base portion having a second sliding surface, and the wall comprises a third sliding surface, wherein the first sliding surface and the second sliding surface are configured to engage with and translate along the third sliding surface.

3. The diffuser assembly of claim 2, wherein the first base portion and the second base portion are disposed within the interior volume of the housing, the first flange extends from the first base portion into the passage, and the second flange extends from the second base portion into the passage.

4. The diffuser assembly of claim 1, comprising a guide tab coupled to a first surface of the wall to form a guide channel between the first surface of the wall and a second surface of the guide tab, wherein the first adjustment panel comprises a base portion disposed within the guide channel, and wherein the guide tab is configured to guide translation of the base portion along the wall.

5. The diffuser assembly of claim 1, wherein the mounting portion comprises a first aperture formed therein, and the mounting section comprises a plurality of second apertures formed therein, wherein the first aperture and a corresponding aperture of the plurality of second apertures are configured to receive a fastener to secure the first adjustment panel to the wall at one of a plurality of discrete positions.

6. The diffuser assembly of claim 1, wherein the wall comprises a third flange extending from the surface and about the perimeter of the passage, wherein the mounting section forms a portion of the third flange.

7. The diffuser assembly of claim 1, wherein a first length of the mounting portion is substantially equal to a second length of the mounting section.

8. The diffuser assembly of claim 1, wherein the first adjustment panel comprises a mounting slot formed therein, the wall comprises an aperture formed therein, and wherein the aperture and the mounting slot are configured to receive a fastener to moveably couple the first adjustment panel to the wall.

9. The diffuser assembly of claim 8, wherein engagement between the fastener, the mounting slot, and the aperture enables movement of the first adjustment panel along a first axis extending along a width of the housing and substantially blocks movement of the first adjustment panel along a second axis extending cross-wise to the first axis.

10. The diffuser assembly of claim 1, wherein the first adjustment panel and the second adjustment panel are self-similar.

11. A diffuser assembly for a heating, ventilation, and air conditioning (HVAC) system, the diffuser assembly comprising:

a wall having a passage extending therethrough;

a first adjustment panel moveably coupled to the wall and comprising a first flange extending into the passage; and a second adjustment panel moveably coupled to the wall and comprising a second flange extending into the passage, wherein the first flange and the second flange define at least a portion of an inlet port extending through the passage and configured to fluidly couple to a duct, wherein the first adjustment panel and the second adjustment panel are configured to translate along the wall between a first configuration to define a first size of the inlet port and a second configuration to define a second size of the inlet port, wherein the wall comprises a third flange that defines a perimeter of the passage, wherein, in the first configuration, the first flange is configured to engage a first section of the perimeter and the second flange is configured to engage a second section of the perimeter such that a first cross-sectional area of the inlet port is substantially equal to a second cross-sectional area of the passage.

12. The diffuser assembly of claim 11, wherein, in the second configuration, the first flange engages the second flange such that the first flange and the second flange are offset from the perimeter of the passage and define a third cross-sectional area of the inlet port that is less than the second cross-sectional area of the passage.

13. The diffuser assembly of claim 12, wherein the first adjustment panel and the second adjustment panel comprise base portions configured to engage with and translate along the wall, wherein, in the second configuration of the first adjustment panel and the second adjustment panel, the base portions are configured to occlude a portion of the passage.

14. The diffuser assembly of claim 11, wherein the inlet port is configured to physically couple to an end portion of the duct of the HVAC system.

15. A diffuser assembly for a heating, ventilation, and air conditioning (HVAC) system, the diffuser assembly comprising:

a housing comprising a wall and a passage formed in the wall;

a first adjustment panel comprising a first base portion moveably coupled to the wall, and comprising a first flange extending from the first base portion into the passage; and a second adjustment panel comprising a second base portion moveably coupled to the wall, and comprising a second flange extending from the second base portion into the passage, wherein the first flange and the second flange define at least a portion of an inlet port extending through the passage and configured to receive an air flow from a duct, and wherein the first base portion and the second base portion are configured to translate along the wall to expose or occlude a portion of the passage to adjust a size of the inlet port in the passage, wherein the wall comprises a mounting section extending from a surface of the wall and forming a portion of a perimeter of the passage, wherein the first flange comprises a mounting portion, and wherein the mounting portion of the first flange is configured to couple to the mounting section of the wall to secure the first adjustment panel to the wall.

16. The diffuser assembly of claim 15, wherein the housing comprises an additional wall and a web extending between the wall and the additional wall to define an interior volume of the housing, wherein the interior volume extends between a first inner surface of the wall and a second inner surface of the additional wall, and wherein the first base portion and the second base portion are disposed within the interior volume.

17. The diffuser assembly of claim 16, comprising a guide tab coupled to the first inner surface of the wall to form a channel between the first inner surface and a surface of the guide tab, wherein the first base portion is disposed within the channel, and wherein the guide tab is configured to guide translation of the first base portion along the first inner surface.

18. The diffuser assembly of claim 15, wherein the first base portion comprises a mounting slot formed therein and the wall comprises an aperture formed therein, wherein the aperture and the mounting slot are configured to receive a fastener to moveably couple the first base portion to the wall.

19. The diffuser assembly of claim 15, wherein a first length of the mounting portion is substantially equal to a second length of the mounting section.

* * * * *